US007796093B1

(12) United States Patent
Scott

(10) Patent No.: US 7,796,093 B1
(45) Date of Patent: Sep. 14, 2010

(54) HELICOPTER TRANSPORTABLE ANTENNA MAST AND STAY CABLE SYSTEM

(75) Inventor: Gary Lee Scott, Richmond, TX (US)

(73) Assignee: Geokinetics Acquisition Company, Houston, TX (US)

( * ) Notice: Subject to any disclaimer, the term of this patent is extended or adjusted under 35 U.S.C. 154(b) by 888 days.

(21) Appl. No.: 11/654,274

(22) Filed: Jan. 16, 2007

(51) Int. Cl.
*H01Q 1/12* (2006.01)

(52) U.S. Cl. ..... 343/874; 343/890

(58) Field of Classification Search ..... 343/874, 343/875, 890, 891, 705
See application file for complete search history.

(56) References Cited

U.S. PATENT DOCUMENTS 4,027,359 A 6/1977 Tinker
5,233,809 A 8/1993 Gropper
5,363,116 A 11/1994 Allen
5,531,419 A 7/1996 Gustafsson et al.
6,018,325 A * 1/2000 Lundgren ..... 343/890
6,390,435 B1 5/2002 Gustafsson
6,464,196 B1 10/2002 Crookham et al.
6,474,617 B1 11/2002 Sahertian
6,702,522 B2 3/2004 Silber
6,888,512 B1 5/2005 Daigler
7,089,705 B1 * 8/2006 Lieberman ..... 52/146

* cited by examiner

*Primary Examiner*—Michael C Wimer
(74) *Attorney, Agent, or Firm*—Karen B. Tripp

(57) ABSTRACT

An antenna mast system includes an antenna mast and a plurality of circumferentially spaced apart upper cable tensioning arms each coupled at one end proximate the top of the mast. A plurality of circumferentially spaced apart lower cable tensioning arms are each coupled at one end to the mast at a selected distance below the upper cable tensioning arms. A plurality of stay cables are each coupled at one end to one of the upper cable tensioning arms and at the other end to an anchor affixed to the ground. The stay cables are each coupled to a respective one of the lower tensioning arms. The system includes means for tensioning the stay cables.

31 Claims, 4 Drawing Sheets

HELICOPTER TRANSPORTABLE ANTENNA MAST AND STAY CABLE SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of masts used to support radio antennas. More specifically, the invention relates to antenna support masts that are transportable and installable using helicopters or other lifting devices for installation in difficult to access terrain.

2. Background Art

Antennas used for various types of radio communication are typically supported by an antenna mast or similar vertically oriented support column or structure. A purpose for an antenna mast is to hold an antenna element at a selected distance above the ground surface so as to increase the effective range of the radio communication devices coupled to the antenna element, and/or to move the antenna element above vegetation or other obstruction to operation of the antenna element.

Representative antenna support masts known in the art are described, for example in U.S. Pat. Nos. 5,531,419 and 6,390,435 issued to Gustaffson. Another antenna mast is described in U.S. Pat. No. 5,233,809 issued to Gropper.

It is desirable, particularly where the radio communication equipment is moved frequently, and more particularly in difficult access terrain such as rain forests and other dense vegetation, to be able to install, assemble, and remove an antenna mast using a helicopter or similar aircraft, or a lifting device such as a crane. Such installation and removal would be facilitated if it were possible to leave the mast essentially fully assembled during removal and transportation, so as to avoid the need to reassemble the mast at each new location.

SUMMARY OF THE INVENTION

An antenna mast system according to one aspect of the invention includes an antenna mast and a plurality of circumferentially spaced apart upper cable tensioning arms each coupled at one end proximate the top of the mast. A plurality of circumferentially spaced apart lower cable tensioning arms are each coupled at one end to the mast at a selected distance below the upper cable tensioning arms. A plurality of stay cables are each coupled at one end to one of the upper cable tensioning arms and at the other end to an anchor affixed to the ground. The stay cables are each coupled to a respective lower tensioning arm at an intermediate point along their length. The system includes means for tensioning the stay cables.

A method for assembling an antenna mast according to another aspect of the invention includes supporting an antenna mast in a substantially vertical position by tensioning a support cable. Stay cables affixed to circumferentially spaced apart tensioning arms coupled to the mast are laterally extended from the mast. The tensioning arms are affixed to the mast at two longitudinal positions along the mast. A free end of each stay cable is affixed to a corresponding anchor. The support cable is then removed from the mast.

Other aspects and advantages of the invention will be apparent from the following description and the appended claims.

DETAILED DESCRIPTION

Figure 1:
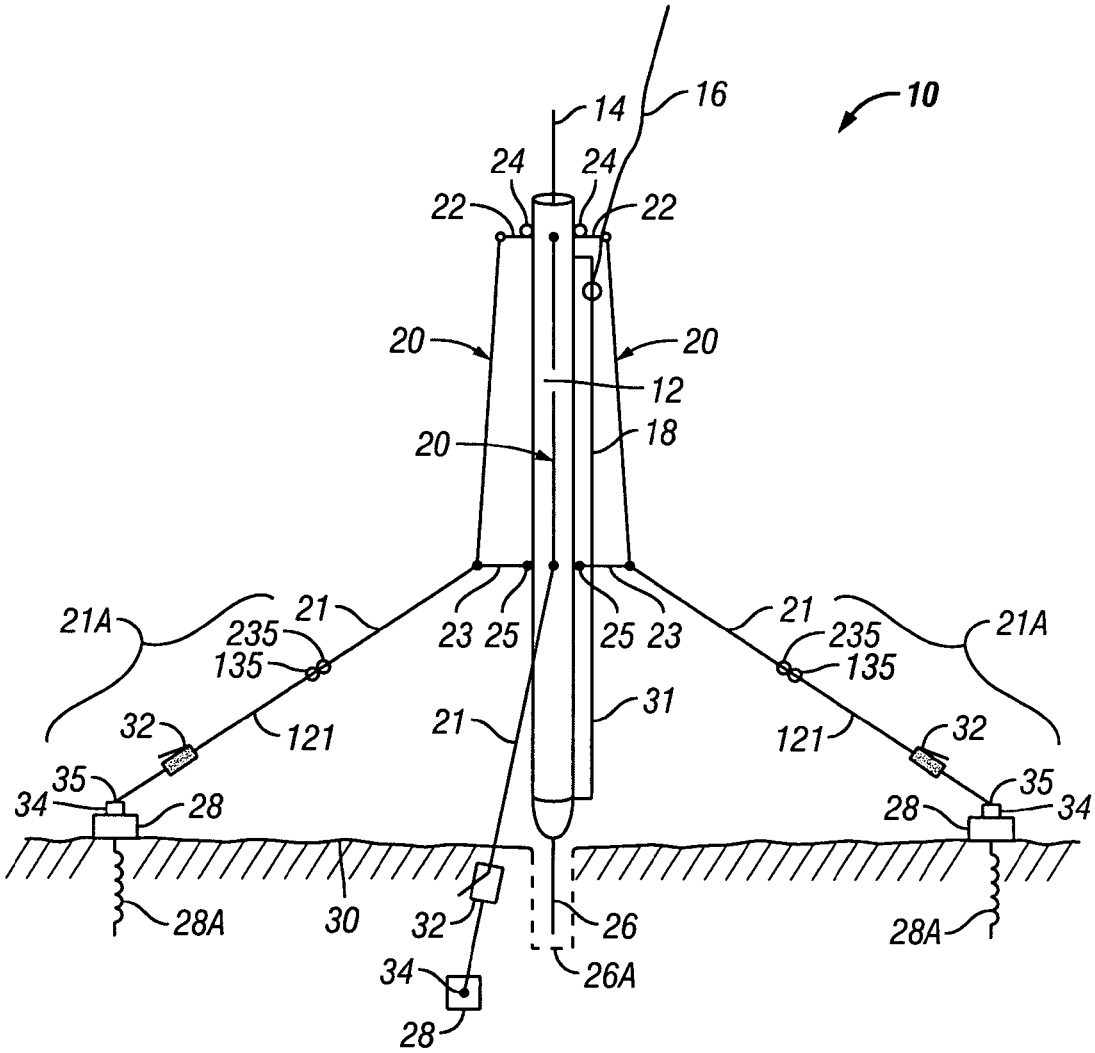
FIG. 1 shows one example of an antenna and stay cable system installed, assembled and erected at a particular location.

One example of an antenna mast and stay cable system according to the invention is shown installed and assembled in FIG. 1. The mast and stay cable system 10 includes an elongated antenna mast 12. The antenna mast 12 may be made from tubular segments (not shown separately in FIG. 1) joined together end to end, such as by threaded coupling, pinning or other device known in the art to couple segments longitudinally to form an elongated element (and as will be explained with reference to FIGS. 7 and 8). The mast 12 may be made from aluminum or other high strength, lightweight metal, or from fiber reinforced plastic, such as glass fiber or graphite fiber reinforced plastic. The materials described herein to make the mast 12 are not intended to limit the scope of the invention, rather, the example materials described herein are intended to present useful guidelines for selection of such material for the mast 12.

Figure 7:
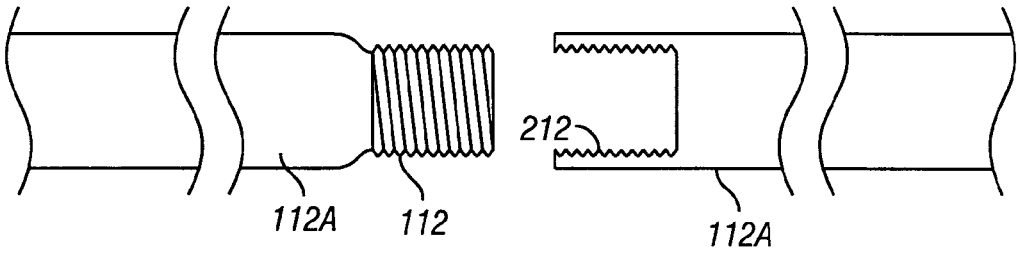
FIG. 7 shows mast segments threadedly coupled end to end.
Figure 8:
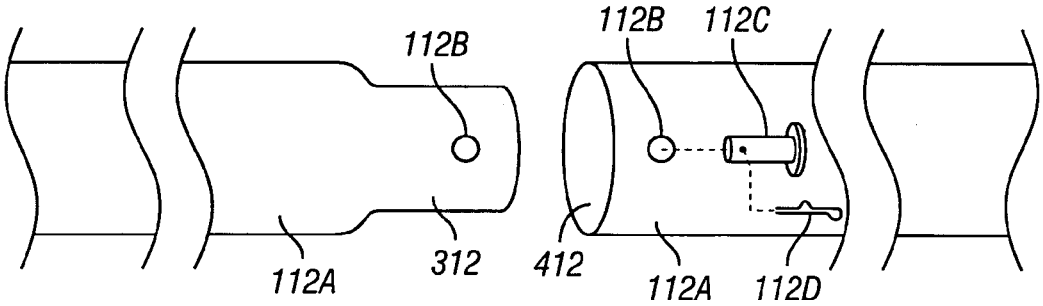
FIG. 8 shows mast segments pinned together end to end.

Examples of coupling mast segments end to end are shown in FIGS. 7 and 8. FIG. 7 shows a mast segment 112A having a male threaded coupling 112 at one end. The threads on the male threaded coupling 112 are configured to mate with threads on a corresponding female threaded coupling 212 disposed at the longitudinal end of an adjacent mast segment 112A. FIG. 8 shows a mast segment having a reduced diameter pin end 312 and a hole 112B therethrough for a locking pin 112C. A mating box end 412 with corresponding locking pin hole 112B is shown at the longitudinal end of an adjacent mast segment 112A and accepts therein the pin end 312. The locking pin 112C is inserted through the holes 112B in both segments 112A when they are placed together. The pin 112C may be retained in place by a "hairpin" spring clip 112D or similar retaining element.

Figure 4:
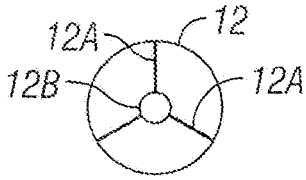
FIGS. 4 and 5 show cross sections of various embodiments of a mast.
Figure 5:
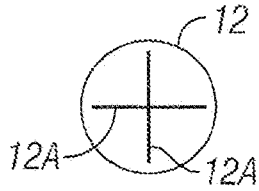

The mast 12 may be configured as substantially cylindrical, elongated tubular segments. FIG. 4 shows one example of a composite tubular structure that may have improved lateral rigidity (bending stiffness) and crush resistance as compared with that of a single wall, hollow tube. The mast 12 in FIG. 4 includes a support tube 12B disposed substantially coaxially with the mast 12 and coupled to the interior of the mast 12 by a plurality of circumferentially spaced apart support ribs 12A. An alternative composite structure is shown in cross-section in FIG. 5, wherein there are only lateral support ribs 12A inside the mast 12 coupled to each other as shown. Various embodiments of a composite structure are intended to increase the bending stiffness and crush resistance of the mast 12 without substantially increasing its overall weight. Other composite structures will occur to those skilled in the art.

Returning to FIG. 1, the mast 12 may have a length in the range of about 40 to 120 feet (13 to 40 meters) although the particular length of the mast 12 is not intended to limit the scope of the invention. The length of the mast 12 used in any particular application of the mast and stay cable system 10 may be selected such that an antenna element 14 disposed at the upper end of the mast 12 will be positioned above any vegetation or other obstruction to radio communication. If the mast 12 is formed from longitudinally coupled segments (not shown in FIG. 1) as explained above, the length of the mast 12 may be readily changed to suit the particular application.

The mast 12 may be supported on its bottom end when the system 10 is erected by a support spike 26 coupled or affixed to the bottom end of the mast 12. The support spike 26 may be a sharp pointed, rigid device intended to penetrate the ground surface 30 when the mast 12 is lowered to the ground 30, or, alternatively, the support spike 26 may be a blunt-ended device configured to rest in a suitable receptacle 26A inserted into the ground 30. The purpose of the support spike 26, however secured to the ground 30, is to prevent lateral movement of the bottom of the mast 12. In the event a receptacle 26A is used, the mast 12 may be configured without a support spike as a separate and distinct element. In such case, the lower end mast 12 may be inserted directly into the receptacle 26A.

During assembly of the mast system 10, the mast 12 may be suspended from one end of a support cable 16. The other end of the support cable 16 may be held above the mast position from a helicopter (not shown in FIG. 1) or other device such as a crane or winch. The cable 16 may be slidably connected to the mast 12 by a cable support 31, which may be in the form of a rod, channel, I-beam, stretched cable or other structure that can slidably support a cable loop, closed eye, ball or other termination coupled to or formed in the end of the cable 16. In the present embodiment, the cable support 31 may be in the form of a rod to engage a loop in the end of the cable 16, and will be referred to herein for convenience as the cable support rod or support rod. The support rod 31 may be configured such that when the mast 12 is supported by the helicopter (not shown) or other device, the cable 16 will be stopped from moving at the upper end of the cable support rod 31 so as to transfer the weight of the mast 12 through the end of the support rod 31 to the cable 16 (and thus to the helicopter or other device). The mast 12 may thus be held in a near vertical orientation by the tension on the cable 16 during assembly of the mast system 10. After assembly of the mast system 10 is substantially completed so as to laterally support the mast 12, as will be explained further below, the helicopter (not shown) or other device may extend the cable 16. When the mast 12 is supported laterally, extending the cable 16 will cause it to slide down the support rod 31 so as to enable its removal from the bottom of the support rod 31. The helicopter (not shown) or other device may then retract the cable 16 and leave the mast system 10 assembly location.

The mast 12 may be laterally supported in a plurality of circumferential directions to remain in an approximately vertical orientation by a stay cable system. The stay cable system may include three or more circumferentially spaced apart upper stay cables 20 and corresponding, circumferentially spaced apart lower stay cables 21. Preferably, there are three of each of such stay cables 20, 21, coupled to the mast 12 by devices to be further explained below, at approximately equal circumferential spacing from each other. Other examples may use more than three of each of such stay cables 20, 21 also preferably substantially equally circumferentially spaced apart.

The upper stay cables 20 may each be coupled proximate the upper end of the mast 12 to the free end of a respective tensioning arm 22. The tensioning arms 22 may each be on the order of 6 to 12 inches length, and may be rotatably coupled to the mast 12 by a spring-loaded hinge 24 disposed on the mast 12. The spring loaded hinge 24 is arranged such that when tension is removed from the upper tensioning arm 22, the arm 22 rotates about the hinge 24 longitudinally to move the free end of the upper tensioning arm 22 toward the mast 12. Conversely, pulling on the free end of the tensioning arm 22 will cause it to extend laterally away from the mast 12. In the positions shown in FIG. 1, the tensioning arms 20 are rotated away from the mast 12 by tension applied to the upper stay cables 20. The manner in which such tension is applied to the upper stay cables 20 will be further explained below.

The lower end of each upper stay cable 20 may be coupled to a movable end of a respective lower tensioning arm 23. The lower tensioning arms 23 are preferably equal in number to the upper tensioning arms 22, circumferentially spaced apart from each other, and preferably each such lower tensioning arm is disposed in about the same circumferential orientation as corresponding upper tensioning arms 22. The lower tensioning arms 23 may be located at a vertical position along the mast 12 such that lower tensioning cables 21 when fully laterally extended as shown in FIG. 1 are able to avoid contact with vegetation or other obstructions when they are installed and placed in tension, yet at the same time provide sufficient lateral restraint to the mast 12 to hold the mast 12 in a substantially vertical orientation. Each lower tensioning arm 23 may be rotatably coupled to the mast 12 by a corresponding spring-loaded hinge 25. Rotation of the lower tensioning arms 23 about their respective hinges 25 serves to extend the free end of each tensioning arm 25 laterally outward from the mast 12, just as is the case for the upper tensioning arms 22. Spring tension from the hinges 25 tends to urge the lower tensioning arms 23 toward the closed position, wherein the free ends thereof are moved toward the mast 12.

Because the lower 23 and upper 22 tensioning arms are coupled to each other by a respective one of the upper stay cables 20, when the lower stay cables 21 are extended and extends the lower tensioning arms 23, such motion causes corresponding extension of the upper tensioning arms 22. When the lower 21, and correspondingly the upper stay cables 20 are fully tensioned, and the upper 22 and lower 23 tensioning arms are fully extended, the combination of the tensioned upper stay cables 20 and extended upper 22 and lower 23 tensioning arms form a structure that increases bending resistance of the portion of the mast 12 disposed longitudinally between the lower tensioning arms 23 and the upper tensioning arms 22.

The lower tensioning arms 23, as explained above, each may also be coupled at the outer ends thereof to one end of a respective one of the lower stay cables 21. Each lower stay cable 21 is coupled at its other end directly or through one or more intermediate devices to a respective anchor 28 secured to the ground 30. The anchors 28 are preferably arranged in a similar circumferential spacing about the mast 12 as the upper 22 and lower 23 tensioning arms. The anchors 28 are preferably located a sufficient lateral distance from the mast 12 to provide sufficient stability to the mast 12 to keep the mast 12 in a substantially vertical orientation. Such lateral distance may depend on, for example, the height above the ground 30 at which the lower tensioning arms 23 are disposed along the mast 12 and the available exposed area on the ground 30 for placing the anchors 28. In the present example, the anchors 28 may include an augur-shaped or screw-shaped device 28A at the bottom thereof such that the anchor 28 may be retained in the ground 30 by such device. The anchor 28 in such embodiments is affixed to the ground 30 by rotating the anchor 28 and correspondingly the device 28A. Each anchor 28 may include a retaining eye 34 for attaching the free end of the respective lower stay cable 21.

Figure 3:
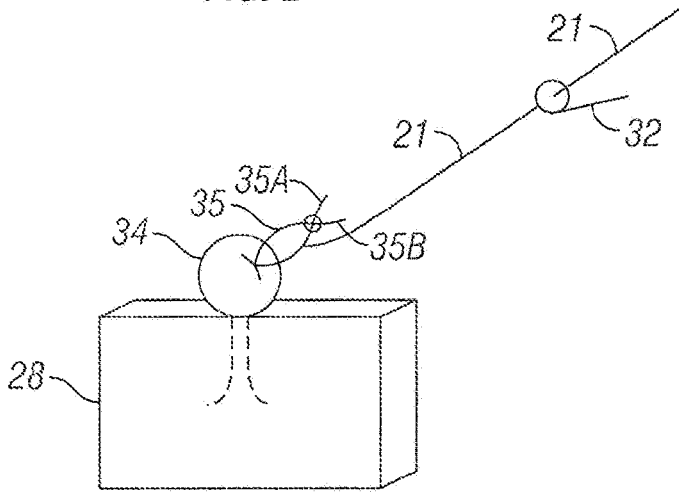
FIG. 3 shows a detailed view of an example device to releasably couple a stay cable to an anchor and to apply tension to the stay cable.

In the present example, each lower stay cable 21 may be affixed to the respective anchor eye 34 using a quick connect 35, to be explained further with reference to FIG. 3. In the present example, tension on each lower stay cable 21 may be adjusted by a tensioner 32 affixed to or disposed along each lower stay cable 21. To assemble the mast 12, the helicopter (not shown) or other supporting device lowers the mast 12 toward the ground 30 by extending the cable 16. One or more users (not shown) may guide the support spike 26 to a selected position, such as the receptacle 26A. While the mast 12 remains supported by the cable 16, the users may affix each lower stay cable 21 to a respective anchor 28 by coupling each quick connect 35 to its respective anchor eye 34. The cable 16 may then be lowered proximate to the ground 30 and the end of the support cable 16 may be removed from the lower end of the support rod 31. The helicopter (not shown) or other device may then retract the cable 16 and move away from the location. The users may then operate each tensioner 32 such that each of the tensioning arms 22, 23 is fully laterally extended.

While the foregoing example of assembly of the mast system 10 is explained in terms of using a helicopter to provide vertical mast support prior to engaging the lower stay cables 21, it will be apparent to those skilled in the art that other devices may be used to vertically support the mast 12 during assembly of the system 10. For example a crane may be used, or a winch and pulley system, wherein an upper pulley is affixed to a high position in a tree or other raised device.

Tension applied to the lower stay cables 21 during their assembly to the anchors 28, and any subsequent increase in tension by operation of the tensioners 32, as explained above causes the lower tensioning arms 23 to be moved to their laterally outwardmost positions. As the free ends of the lower tensioning arms 23 are moved laterally away from the mast 12 and downwardly, the movement thereof is transmitted to the upper stay cables 20, and correspondingly, to the upper tensioning arms 22. Such transmitted motion causes the upper tensioning arms 22 to have their free ends moved away from the mast 12. In the foregoing example, the spring tension on the upper tensioning arms 22 and the lower tensioning arms 23 provided by respective hinge-mounted torsion springs (FIG. 2) or other springs can provide a substantial amount of the total tension applied to the stay cables 20, 21.

Figure 2:
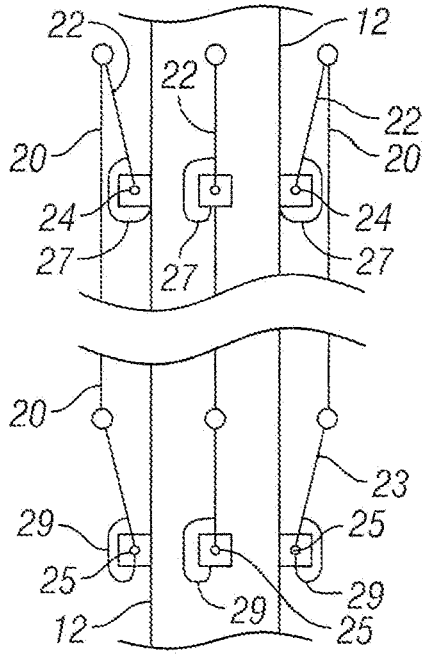
FIG. 2 shows a detailed view of tensioning arms used in the example of FIG. 1.

Referring to FIG. 2, the upper tensioning arms 22 and lower tensioning arms 23 are shown in their retracted positions, that is, with the free ends moved laterally proximate the mast 12. Each of the upper tensioning arms 22 can be urged into its retracted position, as shown, by means of a torsion spring 27 disposed around each pivot 24 and configured to rotate the free end of each corresponding upper tensioning arm 22 toward the mast 12. Correspondingly, each lower tensioning arm 23 may be urged into its laterally retracted position by an associated torsion spring 29. As the lower tensioning arms 25 are pulled away from the mast 12 by the users pulling on the lower stay cables 21 and engaging the quick connects (35 in FIG. 1), as explained above, the torsion springs 27, 29 provide tension on both the lower stay cables (21 in FIG. 2) and on the upper stay cables 20. Tension thus maintained on the upper stay cables 20 provides the combined structure of mast 12 and upper stay cables 20 with substantial resistance to lateral deflection such as by wind or the weight of any equipment installed near the top of the mast 12, including the antenna element (14 in FIG. 1).

FIG. 3 shows a more detailed view of the quick connect 35 coupled to the anchor eye 34. The quick connect 35 may include two, spring loaded levers 35A, 35B which are ordinarily urged such that the distal ends overlap, forming a closed loop as shown in FIG. 3. When a user depresses the two open ends of the levers 35A, 35B together, the loop opens, enabling the loop to be removed from (or affixed to) the eye 34. The tensioner may be a wire "come-along" of any type known in the art. See, for example, U.S. Pat. No. 4,027,359 issued to Tinker.

Referring once again to FIG. 1, to remove the mast system 10, a helicopter or other device may return to the location, and extend the cable 16 so that a user may affix it to the lower end of the support rod. The helicopter or other device may then retract the cable 16 until at least some tension is applied thereto. Users (not shown) may then operate the tensioners 32 to release some of the tension on the lower stay cables 21. The users may then release the quick connects 35, so as to disengage the lower stay cables 21 from the anchors 28. In some embodiments, the users may secure the free ends of the lower stay cables 21 to the lower end of the mast 12. The helicopter may then retract the cable 16 and remove the mast 12 from the ground 30. The mast 12 may be moved to a different location for subsequent assembling.

Figure 6:
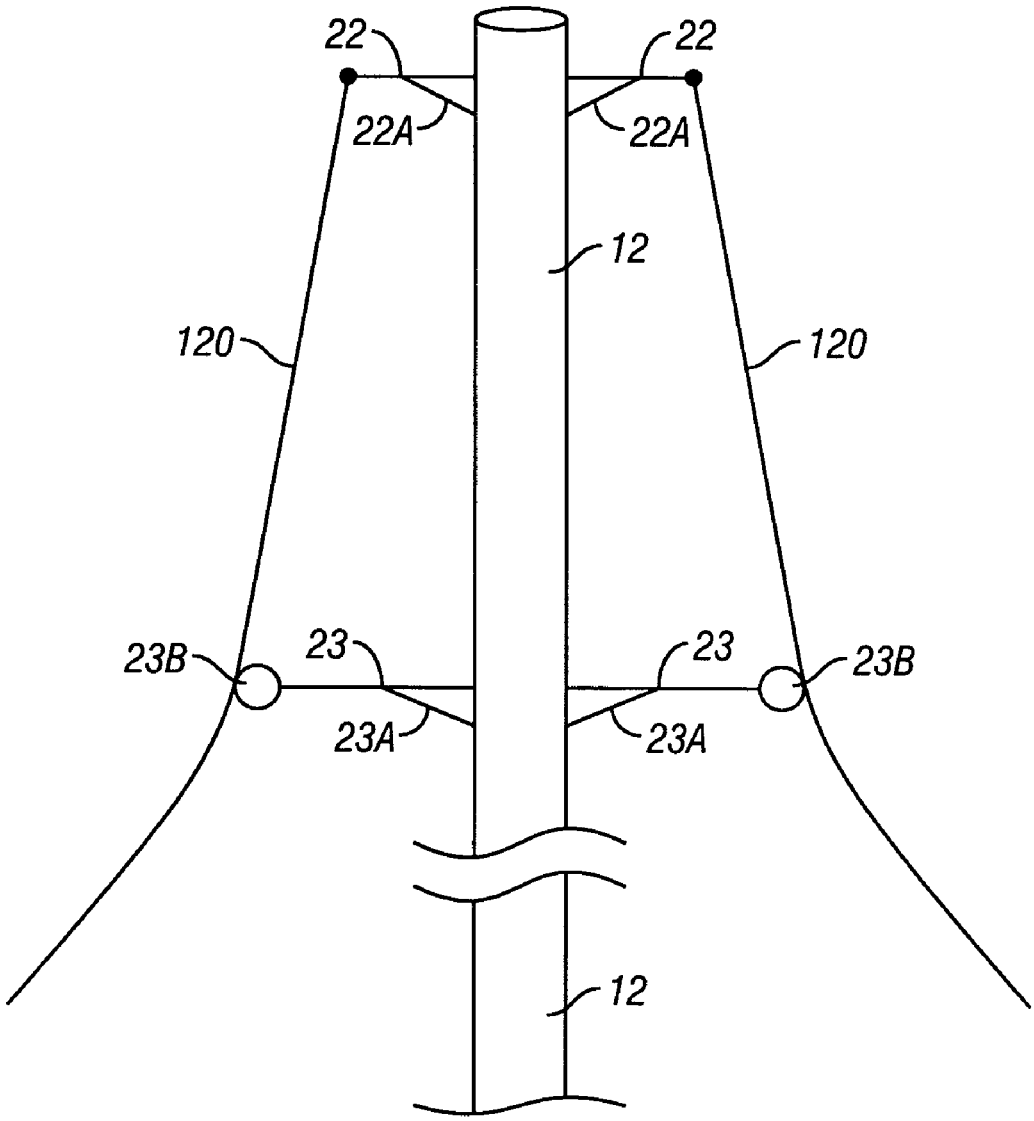
FIG. 6 shows another example of stay cables secured to upper and lower tensioning arms.

In other examples, the tensioning arms 22, 23 may be fixedly coupled to the mast so as to extend laterally perpendicularly outward from the longitudinal axis of the mast, substantially as shown in FIG. 1. In such implementations, the lower stay cable 21 and the upper stay cable 20 may each be formed from single length of wire rope or the like, and fixedly attached to the outer end of one of upper tensioning arms. The outer end of each lower tensioning arm 23 may include an eye (not shown in FIG. 1) or other closed guide such that tension on the lower stay cable 21 will be directly applied to the upper stay cable 20. An example of such implementation is shown in FIG. 6. The upper tensioning arms 22 may be fixedly mounted to the mast 12. In the present example, the upper tensioning arms 22 may be supported in a substantially horizontal (with respect to a vertically oriented mast 12) position by angle braces 22A. A similar arrangement with angle braces 23A is provided in the present example for the lower tensioning arms 23. The outer end of each of the lower tensioning arms 23A may include an eye 23B to enable a stay cable 120 to pass therethrough. Such a stay cable 120 may be secured to the end of each of the upper tensioning arms 22, and pass through the respective eye 23B. The other end of the stay cable 120 may be affixed to a respective anchor (28 in FIG. 1) directly or through an end cable assembly (21A in FIG. 1) as will be explained below.

In another example, the lower stay cables 21 may be coupled to the anchors indirectly. Referring once again to FIG. 1, in the present example, the lower stay cables 21 may each be terminated by a quick connect, shown at 235. The quick connects 235 may be similar to the quick connects 35 that are coupled to respective ones of the anchor eyes 34. The length of the lower stay cables 21 so terminated with quick connects 235 may be selected such that the lower stay cables 21 when released from the anchors 28 only extend approximately to the bottom of the mast 12 with the tensioning arms 23, 22 fully extended as shown in FIG. 1. During disassembly of the mast system 10 in the present example, the quick connects 235 may be secured to the lower end of the cable support rod 31 so that the lower stay cables 21 are secured for transport. In the present example, the spring tension applied by the lower 23 and upper 22 tensioning arms will remove slack in the lower stay cables 21 during transport. In the present example, the lower stay cables 21 may each be coupled to the respective anchors 28 by an end cable assembly 21A. In the present example, the end cable assembly 21A may include the quick connect 35 described above with reference to FIG. 3 at one end, a length of cable 121 and a tensioner 32 as described above, and a loop 135 at the other end of the cable length 121. During assembly of the mast system 10 in the present example, when the mast 12 is lowered to the ground 30 and supported by the cable 16, the user(s) may assemble one of the end cable assemblies 21A to each anchor 28, and couple the loop 135 of each end cable assembly 21A to the quick connect 235 at the end of each lower stay cable 21. The remainder of the assembly procedure is as described above.

For purposes of defining the scope of this invention, the term "stay cable" is intended to include at least all of the foregoing embodiments of stay cables. Such embodiments include separate upper and lower stay cables, wherein the upper stay cables are connected between the upper and lower tensioning arms, and the lower stay cables are coupled between the lower tensioning arms and either directly to the anchors or indirectly through intermediate devices such as a tensioner and/or end cable assembly. Such embodiments also include a single cable that is coupled at one end to a respective upper tensioning arm, through a respective lower tensioning arm and to a respective anchor, either directly or through an intermediate device such as a tensioner or end cable assembly as explained hereinabove. For purposes of defining the scope of the invention, it is also possible where a quick connect is shown at a cable end for coupling to a loop or eye to substitute an eye or loop at such cable end, and wherein a loop or eye is shown to substitute a quick connect. Accordingly, the location of loops or eyes on the ends of the various cables shown in FIG. 1 is only one possible configuration of such loops or eyes and quick connects.

An antenna mast and stay cable system according to various aspects of the invention may be easily erected and removed from a remote location having dense vegetation or other obstructions to ordinary stay cable configuration. Such an antenna mast and stay cable system may be readily transported from one location to the next.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An antenna mast system, comprising:

an antenna mast;

a plurality of circumferentially spaced apart upper cable tensioning arms each coupled at one end proximate the top of the mast;

a plurality of circumferentially spaced apart lower cable tensioning arms each coupled at one end to the mast at a selected distance below the upper cable tensioning arms;

a plurality of stay cables each coupled at one end to one of the upper cable tensioning arms and at the other end to an anchor affixed to the ground, the stay cables each coupled to a respective one of the lower tensioning arms; and means for tensioning the stay cables.

2. The mast system of claim 1 wherein the upper tensioning arms are hingedly mounted to the mast, and the means for tensioning comprises a spring urging each upper tensioning arm to rotate longitudinally toward the mast.

3. The mast system of claim 2 wherein each spring comprises a torsion spring.

4. The mast system of claim 1 further comprising a support spike disposed at a bottom end of the mast.

5. The mast system of claim 1 wherein the support spike is configured to penetrate the ground surface.

6. The mast system of claim 1 wherein the support spike is configured to rest in a corresponding receptacle in the ground surface.

7. The mast system of claim 1 wherein the upper tensioning arms and the lower tensioning arms are hingedly mounted to the mast and the means for tensioning comprises a spring urging each of the upper and lower tensioning arms to rotate longitudinally toward the mast.

8. The mast system of claim 7 wherein each spring comprises a torsion spring.

9. The mast system of claim 1 wherein the means for tensioning comprises a tensioner disposed in each stay cable between a respective lower tensioning arm and a respective anchor.

10. The mast system of claim 9 wherein each tensioner comprises a wire come-along.

11. The mast system of claim 1 comprising three circumferentially spaced apart upper tensioning arms and three correspondingly circumferentially spaced apart lower tensioning arms.

12. The mast system of claim 1 further comprising a cable support element disposed longitudinally along the mast and a hoisting cable slidably affixable to the cable support element, the cable configured to be retracted so as to hold the mast in a substantially vertical orientation.

13. The mast system of claim 1 wherein the stay cables each comprise an upper stay cable coupled between an outer end of one of the upper tensioning arms and an outer end of a corresponding one of the lower tensioning arms, the stay cables each comprising a lower stay cable each coupled between an outer end of one of the lower tensioning arms and a corresponding one of the anchors.

14. The mast system of claim 13 further comprising a tensioner disposed along at least one of the lower stay cables.

15. The mast system of claim 14 wherein the tensioner comprises a wire come-along.

16. The mast system of claim 1 wherein the mast comprises a mast tube having circumferentially spaced apart support ribs disposed inside the tube and arranged to increase bending stiffness of the tube.

17. The mast system of claim 16 further comprising a support tube coaxially disposed inside the tube and wherein the support ribs extend radially from the support tube to the inside of the mast tube.

18. The mast system of claim 1 further comprising a quick connect disposed at an end of each stay cable coupled to a respective one of the anchors.

19. The mast system of claim 18 further comprising an end cable assembly disposed between a lower end of each stay cable and each corresponding anchor, the end cable assembly including an eye at one end for engagement with a quick connect at the lower end of each stay cable and a quick connect at the other end for engagement with an eye on the respective anchor.

20. The mast system of claim 1 wherein each anchor comprises an augur element for threaded engagement with the ground surface.

21. The mast system of claim 1 wherein the mast is formed from a plurality of mast segments joined end to end.

22. The mast system of claim 21 wherein adjacent mast segments are threadedly coupled.

23. The mast system of claim 21 wherein adjacent mast segments are coupled by a locking pin.

24. A method for assembling an antenna mast comprising:

supporting an antenna mast in a substantially vertical position by tensioning a support cable;

laterally extending stay cables affixed to tensioning arms, the tensioning arms affixed to the mast at two longitudinal positions along the mast;

affixing a free end of each stay cable to a corresponding anchor; and removing the support cable from the mast, wherein the removing the support cable comprises extending the support cable until an end thereof clears a lower end of a support rod affixed to the mast, and withdrawing the support cable.

25. The method of claim 24 wherein they support cable is extended from a helicopter proximate the antenna mast.

26. The method of claim 24 further comprising tensioning the stay cables.

27. The method of claim 26 wherein the tensioning comprises rotatably urging the tensioning arms toward the mast.

28. The method of claim 26 wherein the tensioning comprises operating a wire come-along disposed in each of the stay cables.

29. The method of claim 24 further comprises assembling a plurality of mast segments end to end until the mast is a predetermined length.

30. The method of claim 24 further comprising:

reattaching the support cable to the mast;

tensioning the support cable;

disconnecting the stay cables from the anchors; and lifting the support cable to remove the mast from the ground.

31. The method of claim 30 further comprising:

moving the mast to a different location above the ground;

lowering the mast until a lower end thereof contacts the ground; and repeating supporting the antenna mast in a substantially vertical position by tensioning a support cable, laterally extending the stay cables, affixing the free end of each stay cable to a corresponding anchor, and removing the support cable from the mast.

* * * * *